United States Patent [19]

Hughes, Jr.

[11] Patent Number: 4,538,861

[45] Date of Patent: Sep. 3, 1985

[54] PORTABLE DESK

[76] Inventor: David P. Hughes, Jr., 950 Hobbs Rd., Radnor, Pa. 19087

[21] Appl. No.: 562,857

[22] Filed: Dec. 19, 1983

[51] Int. Cl.[3] ..... A47B 95/02; A45F 3/00

[52] U.S. Cl. ..... 312/244; 190/10; 190/11; 190/109

[58] Field of Search ..... 312/231, 244, 230; 190/900, 902, 109, 10, 11; 206/45.19, 561, 566

[56] References Cited

U.S. PATENT DOCUMENTS

| | | | |
|---|---|---|---|
| 327,749 | 10/1885 | Wulff | 190/11 |
| 791,506 | 6/1905 | Simmons | 312/244 |
| 3,073,057 | 1/1963 | Farber | 312/244 |
| 3,408,126 | 10/1968 | Mortensen | 312/244 |
| 4,244,632 | 1/1981 | Molinari | 190/109 |

*Primary Examiner*—William E. Lyddane

*Assistant Examiner*—Gerald A. Anderson

*Attorney, Agent, or Firm*—Frederick J. Olsson

[57] ABSTRACT

A portable desk of the kind having an exterior working or writing surface and internal compartments for storing writing or work-related items. The desk is useful in support of the activities of traveling business persons such as sales, engineering, and management personnel over and above such desk now known in the trade. The desk having structure to hold important items required by traveling business persons in easily accessible compartments and in a manner such that the items cannot fall out or migrate between compartments when the desk is being carried or shipped. The desk having a two-section cover, the sections being respectively arranged to be pivoted upward to provide access to the whole of the interior or to a part of the interior.

1 Claim, 7 Drawing Figures

PORTABLE DESK

This invention relates to portable desks of the kind having an exterior working or writing surface and internal compartments for storing writing or work-related items.

More specifically, the invention relates to improvements in such desks particularly in structure making the desk highly useful in support of the activities of traveling business persons such as sales, engineering, and management personnel over and above such desks now known in the trade.

One of the objects of the invention is to provide a portable desk of the kind in question having structure to hold important items required by traveling business persons in easily accessible compartments and in a manner such that the items cannot fall out or migrate between compartments when the desk is being carried or shipped.

Another object of the invention is to provide a portable desk of the kind in question having a two-section cover, the sections being respectively arranged to be pivoted upward to provide access to the whole of the interior or to a part of the interior.

Another object of the invention is to provide a portable desk of the kind in question having two types of interior supply compartments, each type having plural sections; one type to hold larger, flat items such as writing pads, file folders, maps, envelopes, and the like; and the other type to hold small items such as pencils, index cards, rulers, clips, erasers, stamps, cassettes, calculators, and the like with the small-item compartments being accessible independently of the large-item compartments.

Another object of the invention is to provide a desk of the kind in question having a flat cover for use in writing together with interior small-item compartments and large-item compartments, the small-item compartments being accessible while one is in the process of writing simply by slightly shifting the writing pad toward the rear and lifting part of the cover whereby new pencils or pens or erasers, etc. are instantly retrievable from storage and without a major dislocation of the writing surface.

The invention will be described below in connection with the following drawing wherein.

Figure 1:
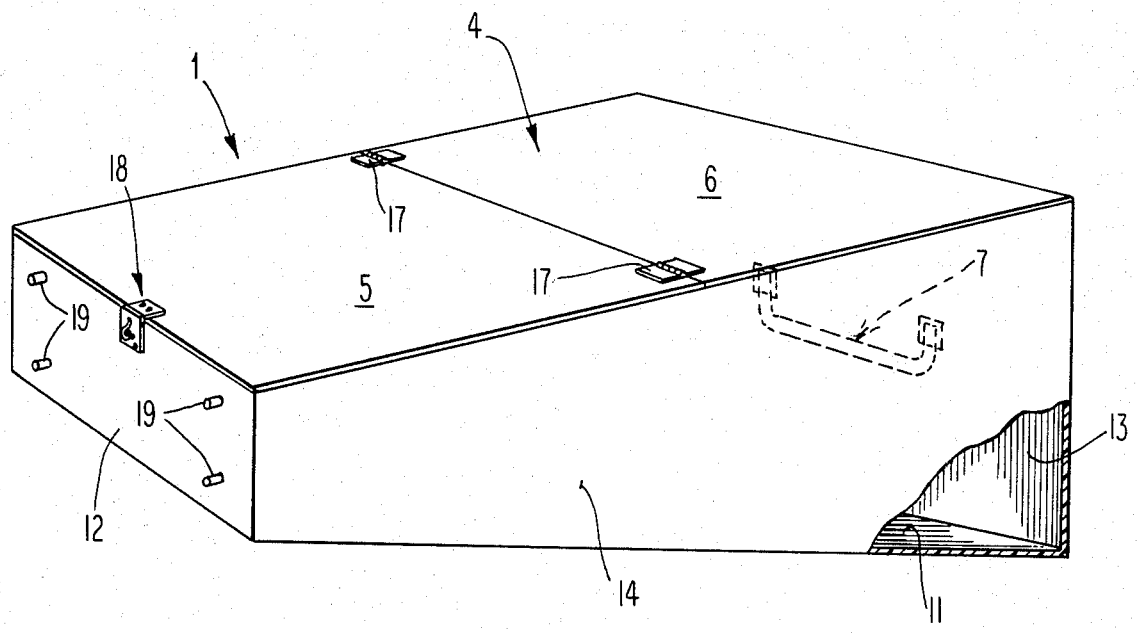
FIG. 1 is a perspective view of the desk of the invention with the cover in closed position.
Figure 2:
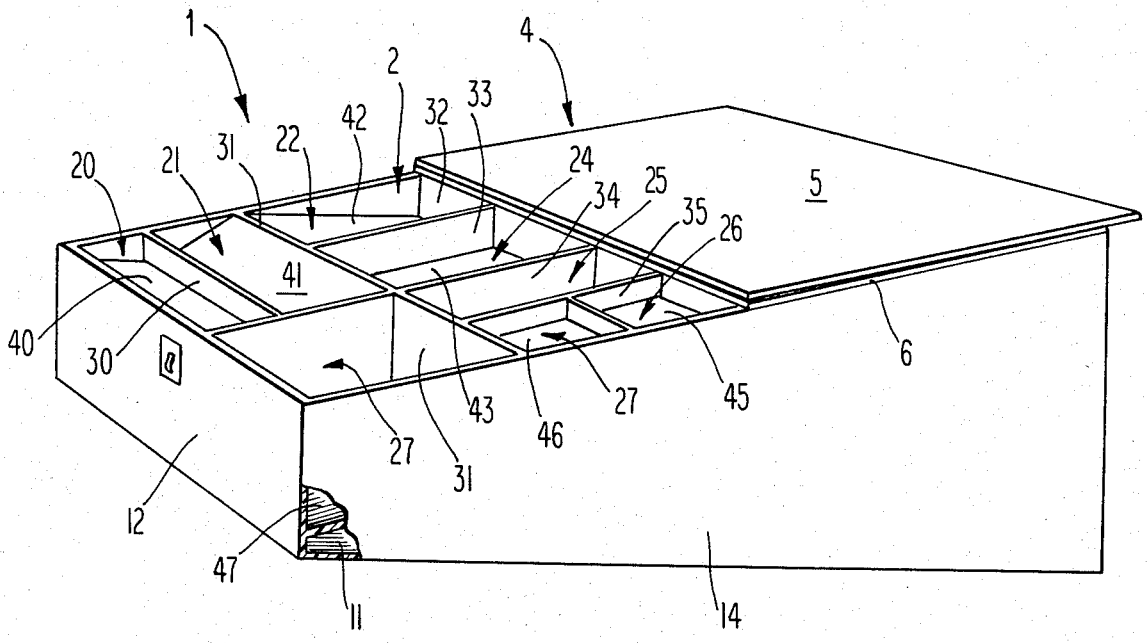
FIG. 2 is a perspective view of the desk of FIG. 1 wherein the front section of the cover is in the open position and the rear section of the cover is in closed position.
Figure 3:
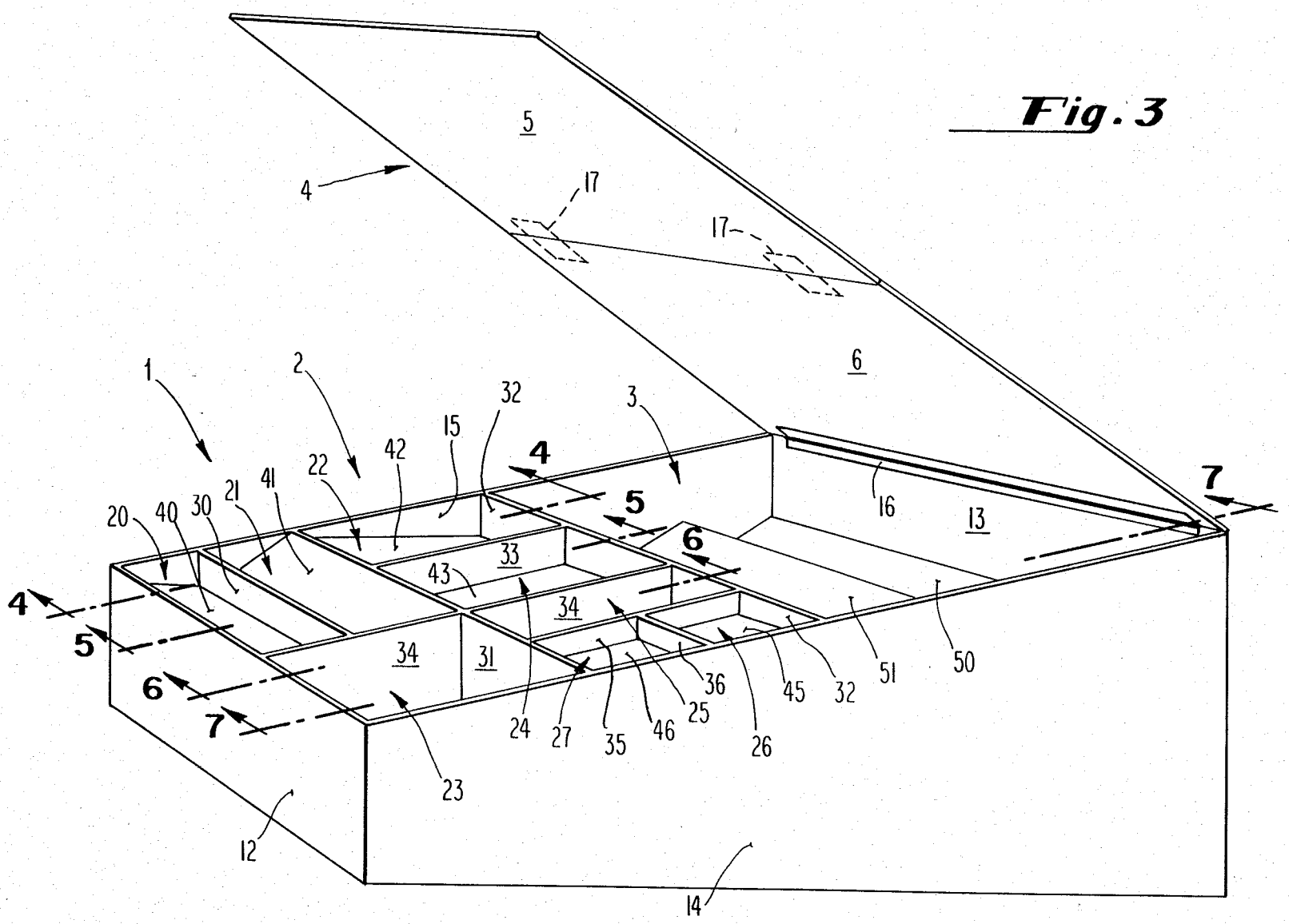
FIG. 3 is a perspective view of the desk of FIG. 1 wherein both the front and rear sections of the cover are in open position.
Figure 4:
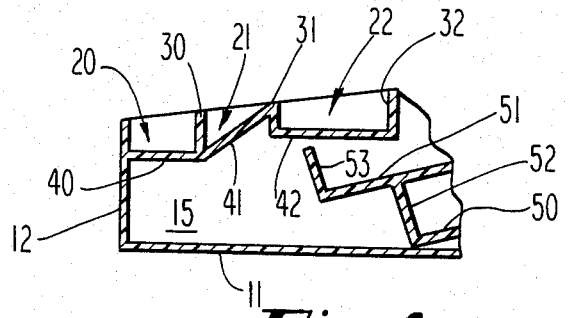
FIG. 4 is a reduced, fragmentary, sectional, elevational view taken along the lines 4—4 of FIG. 3.
Figure 5:
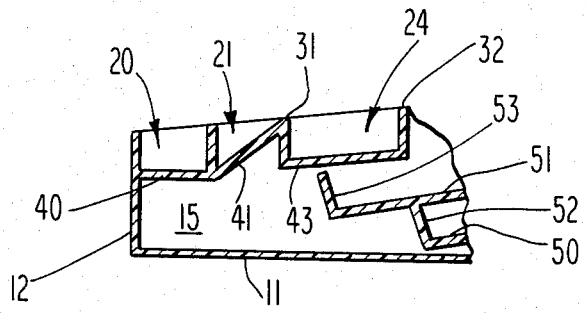
FIG. 5 is a reduced, fragmentary, sectional, elevational view taken along the lines 5—5 of FIG. 3.
Figure 6:
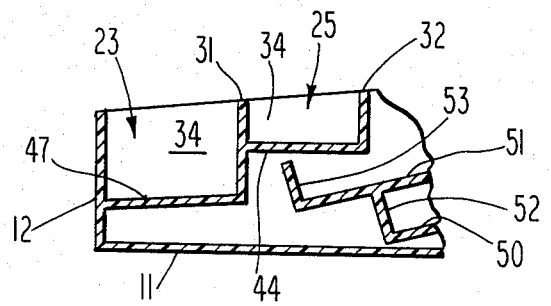
FIG. 6 is a reduced, fragmentary, sectional, elevational view taken along the, lines 6—6 of FIG. 3.
Figure 7:
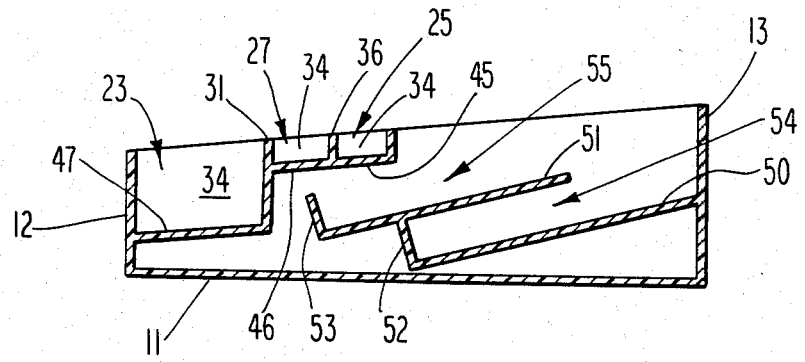
FIG. 7 is a reduced, fragmentary, sectional, elevational view taken along the lines 7—7 of FIG. 3.

Referring to FIGS. 1, 2, and 3, the portable desk, in general, comprises the main housing 1 having interior small-item supply compartments 2, large-item supply compartments 3, and cover 4 having a front section 5 and a rear section 6 to provide access to the interior compartments.

As shown, the desk is set up in its normal use position where it is oriented generally horizontally. A handle 7 (shown in FIG. 1) is used for carrying the desk. In this condition, the desk will be oriented generally vertically.

In FIG. 1, the cover 4 is in closed position. In this position, the top surfaces of the front and rear sections 5 and 6 may be used as a work or writing surface, for example, to hold a writing pad. Also in the closed position of the cover, the supply compartments 2 and 3 are sealed off so that items stored in same cannot fall out or migrate between compartments when the desk is carried.

In FIG. 2 the front section 5 has been moved to an open position. This provides access to the small-item supply compartment 2.

In FIG. 3, the rear section has been moved (carrying the front section with it) to an open position. This provides access to both the small- and large-item supply compartments.

The main housing 1 is comprised of a bottom wall 11, a front wall 12, a rear wall 13, and side walls 14 and 15. The front, rear, and side walls are connected to and extend upwardly from the bottom wall. The side walls are respectively connected to the front and rear walls.

The upper edge of the front wall 12, the upper edge of the rear wall 13, and the upper edges of the side walls 14 and 15 lie in a common plane. The rear wall 13 extends upwardly a greater distance from the bottom wall 11 than the front wall. This orients the common plane of the upper edges at an angle to the bottom wall.

Thus, the cover 4,when in closed position, has a corresponding orientation which is desirable when the cover is employed as a writing surface and especially when the desk is set up on a car seat.

It will be evident from an inspection of FIG. 1, that when the cover sections 5 and 6 are in closed position, the front section 5 engages the upper edge of the front wall 12, the upper edges of the side walls 14 and 15, and that the rear section 6 engages the upper edge of the rear wall 12 and the upper edge of the side walls 14 and 15.

The movement of the cover sections 5 and 6 between the open and closed positions is accomplished by hinges. Thus, referring to FIG. 3, the rear hinge 16 is connected to the top part of the wall 13 and to the underside of the rear section 6. The hinge preferably is a piano hinge type and is substantially co-extensive with the width of the rear wall 13. Referring to FIG. 1, the front hinges 17 pivotally join the sections 5 and 6 together.

The hinges 16 and 17 are connected to the above-mentioned compartments by a conventional means.

When the cover 4 is in the closed position, it is locked by the lock means 18 which is conventional having a fixed keeper (on front wall 12) and a pivoting latch (on front section 5). Since the lock extends slightly outwardly of the front wall 12, the conventional, pressure-sensitive rubber bumpers 19 are employed to allow the desk to be set upright on a floor without tilting.

The details of the small-item storage compartments 2 will next be described.

In the enbodiment shown, there are 8 small-item storage compartments designated 20 through 27. By way of example, the following tabulation will serve to illustrate the suggested use of these compartments:

| COMPARTMENT | EXAMPLE OF USE |
|---|---|
| 20 | Pens, pencils |
| 21 | Calculator-Ruler, plain ruler |
| 22 | Coffee cup, soft drink, measuring tape |
| 23 | Cassettes, telephone answering devices, dictating tapes |
| 24 | Index cards, pocket calculator, pocket dictator, magnifying glass |
| 25 | Small stapler, dictating tapes |
| 26 | Adhesive-backed pads |
| 27 | Paper clips, erasers |

It will be understood, of course, that the exact number of small-item compartments or their respective configurations may be varied depending, for example, where the design of the desk tailors the small-item supply compartments to fit the needs of a particular business person. Nevertheless, all such small-item supply compartments will include divider and platform means as discussed below.

A plurality of divider means, 30 through 36, respectively extend upwardly and each constitutes at least one wall of a small-item compartment. The manner in which the divider means extends and where the same are connected to the front wall 12 and side walls 14 and 15 and connected to one another, will be evident from an inspection of FIGS. 2 and 3. The orientation and vertical extent of the respective divider means is indicated in FIGS. 4, 5, 6, and 7. As will be apparent, some of these divider means form a small-item compartment side walls while other small-item compartment side walls are formed by the front wall 12 and by the side walls 14 and 15.

A plurality of platform means are positioned above the bottom wall 11 and are respectively connected to said divider means and with said front and side walls. The platform means are designated by the numerals 40 through 47.

The manner in which the platform means are joined to the front wall 12 and to the side walls 14 and 15 and to the divider means 30 through 36 will be evident from an inspection of FIGS. 2 through 7. The various platform means respectively constitute the small-item compartment bottoms.

Thus, the aforesaid small-item compartment walls, the front wall 12 and the side walls 14 and 15 of the main housing, and the aforesaid small-item compartment bottoms form the small-item supply compartments 2.

It will be observed that the platform 41 is oriented at a steep angle with respect to the hollow wall 11. This is done so that the scale or screen of a calculator stored in the compartment is readily visable in its storage position and so that it can be quickly removed. The other platforms are oriented either parallel to the bottom wall 11 or the cover 4 for reasons of convenience of accessability of items stored.

With respect to fabrication of the above compartments, it is preferred the same be comprised of plastic such as KYDEX, made by Rohm & Haas. Thus, the cover sections 5 and 6 may be cut from sheets of KYDEX and the main housing and small-item compartments 2 molded as a unitary piece using this material.

The construction of the large-item supply compartments 3 will next be described.

The large-item supply compartments include rear shelf means 50 and front shelf means 51 which are parallel and vertically spaced from one another and are connected between the main housing side walls 14 and 15. Each of the shelf means 50 and 51 extend from a position below the rear-most of the small-item compartments 2 upwardly toward the rear wall 13 at an angle to the bottom wall 11. The rear shelf means 50 has a foot 52 which extends upwardly and is joined to the front shelf 51. The front shelf means 51 also has a foot 53 which extends upwardly toward the small-item compartments 2 and spaced slightly downwardly therefrom.

The shelf means 50 and 51 and the respective foot sections 52 and 53 are molded from KYDEX as a single piece which is inserted inside the main housing and glued to the side walls 14 and 15 at rear wall 13.

The space between the rear shelf means 50 and the front shelf means 51 forms one larger item compartment 54. The space between the front shelf means 51 and the cover section 6 (and the rear-most of the small-item compartments 2) forms another large-item compartment 55.

It will be evident that the compartments 54 and 55 are ideally suited for the storage of maps, mailing envelopes, stationary, file folders, scratch pads, catalogs, fliers, and the like. The shelf means 50 and 51 cooperate with the rear wall 13 and with the rear section 6 when the same is in closed position so that the large items in the compartments 54 and 55 will remain in the compartment irrespective of how the desk is oriented.

I claim:

1. A portable desk comprising:

a main housing comprising a bottom wall, front and rear walls connected to and extending upwards from the bottom wall with the rear wall extending upward a greater amount than the front wall, a pair of side walls connected to and extending upwardly from the bottom wall, and the side walls respectively being connected to said front and rear walls and with the upper edges of the front, rear, and side walls lying in a common plane which is oriented at an angle to the bottom wall;

flat cover means for said main housing comprising a front section and a rear section, the front section having a closed position wherein it engages the upper edge of said front wall and respective portions of the upper edges of said side walls and the rear section having a closed position wherein it engages the upper edges of said rear wall and respective portions of the upper edges of said side walls;

front hinge means connecting said front and rear sections and providing for the front section to be pivoted upwardly from its closed position to an open position to provide access to the interior of said main housing;

rear hinge means connecting said rear section to the upper edge of said rear wall and providing for the rear section to be pivoted upwardly from its closed position to an open position to provide access to the interior of said main housing;

a plurality of divider means each extending upwardly with respect to said bottom wall and each respectively constituting at least one compartment side wall;

platform means positioned above said bottom wall and connected with some of said divider means and with said front and side walls and respectively constituting compartment bottoms;

said compartment side walls, said front and side walls, and said compartment bottoms respectively forming a plurality of small-item supply compartments which can be accessed by pivoting said front section to said open position;

the upper edges of said dividers lying in said common plane and engaging said front section when in the closed position, last said engagement and said engagement of said front section with the upper edges of said side walls and said front wall respectively maintaining items in small-item supply compartment within the same;

flat, rear shelf means connected to said side walls and to said rear wall and said flat surface extending away from the rear wall downwardly toward said bottom wall;

flat, front shelf means connected to said side walls and extending from a position below some of said small-item supply compartments in a direction upwardly away from said bottom wall and toward said rear wall and oriented generally parallel to said rear shelf means;

the space above said front shelf means constituting a large-item supply compartment and the space between said front shelf means and said rear shelf means also constituting a large-item supply compartment, both of the large-item compartments being accessed by pivoting said rear portion to its open position;

said front shelf and said rear shelf each having foot means to limit the toward position of large items stored therein; and said shelf means and said rear section when the same is in the closed position cooperating to maintain large items stored in said large-item storage compartments within the same.

* * * * *